US009909340B2

(12) United States Patent
Bock et al.

(10) Patent No.: US 9,909,340 B2
(45) Date of Patent: Mar. 6, 2018

(54) DEVICE FOR ACTUATING A CLOSING MECHANISM OF A LOCK

(75) Inventors: Peter Bock, Schwelm (DE); Matthias Blunck, Mettmann (DE)

(73) Assignee: Beloxx Newtec GmbH, Wuppertal (DE)

( * ) Notice: Subject to any disclaimer, the term of this patent is extended or adjusted under 35 U.S.C. 154(b) by 642 days.

(21) Appl. No.: 13/266,911

(22) PCT Filed: Apr. 28, 2010

(86) PCT No.: PCT/EP2010/002594
§ 371 (c)(1),
(2), (4) Date: Dec. 22, 2011

(87) PCT Pub. No.: WO2010/124851
PCT Pub. Date: Nov. 4, 2010

(65) Prior Publication Data

US 2012/0090363 A1 Apr. 19, 2012

(30) Foreign Application Priority Data

Apr. 29, 2009 (DE) ..... 20 2009 006 211 U

(51) Int. Cl.
*E05B 47/06* (2006.01)
*E05B 13/10* (2006.01)
(Continued)

(52) U.S. Cl.
CPC ..... *E05B 47/0692* (2013.01); *E05B 13/101* (2013.01); *E05B 37/00* (2013.01);
(Continued)

(58) Field of Classification Search
USPC ..... 70/207, 209, 218, 221, 22, 223, 277, 70/278.1, 278.7, 472
See application file for complete search history.

(56) References Cited

U.S. PATENT DOCUMENTS 6,334,348 B1 * 1/2002 Ming-Chih ..... 70/472
6,360,573 B1 * 3/2002 Ming-Chih ..... 70/277
(Continued)

FOREIGN PATENT DOCUMENTS

DE 38 40 036 5/1990
DE 20 2005 006 957 8/2005
(Continued)

OTHER PUBLICATIONS

International Search Report of PCT/EP2010/002594, dated Sep. 16, 2010.

*Primary Examiner* — Christopher J Boswell
(74) *Attorney, Agent, or Firm* — Collard & Roe, P.C.

(57) ABSTRACT

The invention relates to a device (23) for actuating the locking mechanism of a lock, more particularly a furniture lock, said device comprised of a fixing unit (1) by means of which the device (23) can be fastened to a component, more particularly a door and/or window sash, at which the lock is also arranged, and comprised of a handle (27) which is pivoting mounted about a rotary axis at the fixing unit (1) and through the rotation of which the locking mechanism can be manually actuated, and comprised of a power transmission unit (8) which can be torque-proof coupled to the handle (27) to transmit the power applied on rotating the handle (27) to the locking mechanism, wherein the power transmission unit (8) is not coupled torque-proof to the handle (27) until a release code is entered and authenticated, and wherein the entry of the release code is effected by way of electronically picking-up at least one position of the handle (27) relative to the power transmission unit (8), and wherein the entry of the release code is accomplished by electronically picking-up of at least one position of the handle (27) relative to the power transmission unit (8), and wherein the device is comprised of a coupling mechanism
(Continued)

Figure 1:
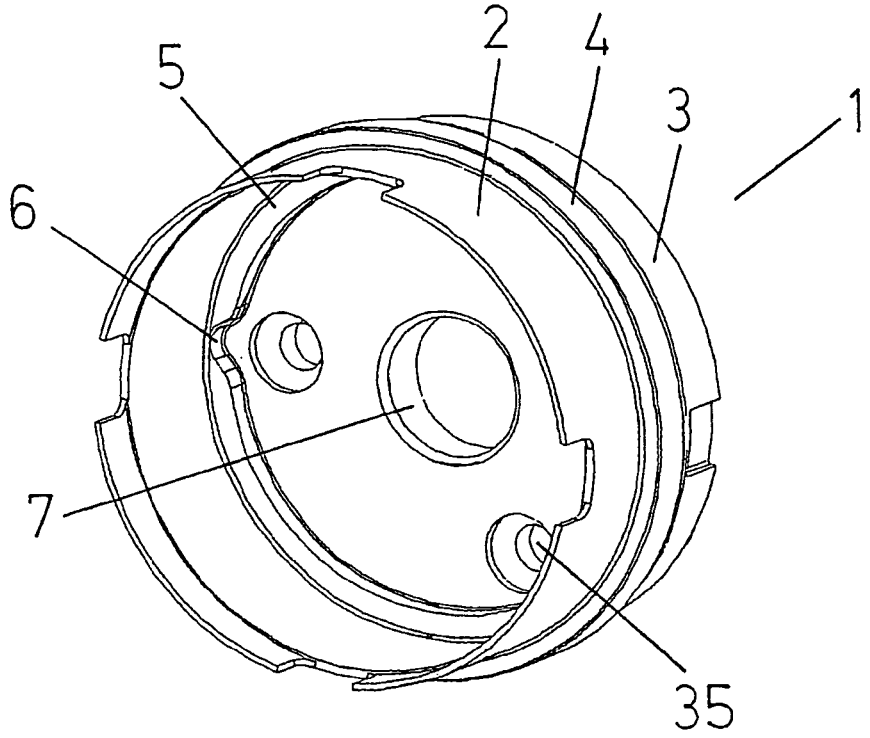

through which the power transmission unit (8) can be torque-proof coupled optionally to the fixing unit (1) or to the handle (27).

9 Claims, 13 Drawing Sheets

(51) Int. Cl.
*E05B 47/00* (2006.01)
*E05B 37/00* (2006.01)
*G07C 9/00* (2006.01)

(52) U.S. Cl.
CPC ..... *E05B 47/0002* (2013.01); *G07C 9/00896* (2013.01); *G07C 9/00658* (2013.01); *Y10T 70/7085* (2015.04)

(56) References Cited

U.S. PATENT DOCUMENTS

| | | | | |
|---|---|---|---|---|
| 6,651,468 | B2 * | 11/2003 | Aramburu et al. | 70/222 |
| 7,231,791 | B2 * | 6/2007 | Sakai | 70/277 |
| 7,543,469 | B1 * | 6/2009 | Tseng et al. | 70/472 |
| 7,827,837 | B2 * | 11/2010 | Huang et al. | 70/277 |
| 7,845,202 | B2 | 12/2010 | Padilla et al. | |
| 7,966,854 | B2 * | 6/2011 | Imedio Ocana | 70/472 |
| 2008/0072637 | A1 | 3/2008 | Padilla et al. | |
| 2008/0196457 | A1 | 8/2008 | Goldman | |
| 2009/0211319 | A1 * | 8/2009 | McCormack | 70/263 |
| 2011/0277520 | A1 * | 11/2011 | Nunuparov | 70/276 |

FOREIGN PATENT DOCUMENTS

| | | |
|---|---|---|
| DE | 10 2006 045 195 | 4/2008 |
| EP | 1 903 168 | 3/2008 |
| GB | 2 262 770 | 6/1993 |
| WO | WO 96/23120 | 8/1996 |

* cited by examiner

DEVICE FOR ACTUATING A CLOSING MECHANISM OF A LOCK

CROSS REFERENCE TO RELATED APPLICATIONS

This application is the National Stage of PCT/EP2010/002594 filed on Apr. 28, 2010, which claims priority under 35 U.S.C. §119 of German Application No. 20 2009 006 211.2 filed on Apr. 29, 2009, the disclosure of which is incorporated by reference. The international application under PCT article 21(2) was not published in English.

The invention relates to a device for actuating the locking mechanism of a lock, more particularly a furniture lock, said device comprised of a fixing unit by means of which the device can be fastened to a component, more particularly a door and/or window sash, at which the lock is also arranged, and comprised of a handle which is pivoting mounted about a rotary axis at the fixing unit and through the rotation of which the locking mechanism can be manually actuated, and comprised of a power transmission unit which can be torque-proof coupled to the handle to transmit the power applied on rotating the handle to the locking mechanism, wherein the power transmission unit is not coupled torque-proof to the handle until a release code is entered and authenticated.

A device of this kind is known, for example, from DE 20 2005 006 957 U1. This electronic device features a power transmission unit which is not coupled torque-proof to the handle until a release code is entered and authenticated and thus IT serves for transmission of the power applied on rotating the handle to the locking mechanism of the lock. The release code is entered by actuating a pushbutton arranged at the handle, said pushbutton being provided with a haptically detectible vibration signal transmitter. A user can scan signals of the switching electronics with its finger tips when controlling and/or programming the electronic interlocking device. By entering a release code through the pushbutton, an electronically actuatable switching clutch of the power transmission unit is brought into its switch-on position in which the handle is connected with the locking mechanism of the lock. Subsequently the lock can be opened or closed by rotating the handle. Once the desired actuation of the locking mechanism has been performed, the electronically actuatable switching clutch can be switched into a switched-off position by entering a locking code through the pushbutton in which position the torque-transmitting connection between the handle and the locking mechanism is interrupted.

The use of such electronic means for locking and unlocking locks at doors, lockers, lockable safe deposits, post office boxes, and facilities of a different configuration is well known. The use is advantageous especially when there is a plurality of users, and more particularly if it is desired, for example, to change the access parameters or to record access and egress times.

The means for entering release and/or locking codes may range from simple keyboards to the use of cell phone or internet connections. Keyboards bear the advantage that they do not require any additional means such as access cards, wherein such access means available in the market for their majority are considered to be a replacement for a physically existing key with another one. The main disadvantage of keyboards is their space demand.

Moreover, due to the necessity for an exchange of batteries unless there is another energy supply available, electronic locks are considered to be unsatisfactory. In general, the demand for energy is substantiated by the use of a motor or gear assembly to actuate the locking mechanism of the lock. For example, if systems with access cards are utilized, the energy consumption of electronic locks is still higher because it is required to search for cards existing in the vicinity of the lock each hour. To resolve this problem, configurations of electronic locks are known in which a switch to "wake-up" the system can be pressed; however, this configuration deteriorates operational comfort substantially.

Against this background, it is the object of the present invention to provide a device for actuating the locking mechanism of a lock, more particularly of a furniture lock, which is autarkic, of a compact design, a low energy consumer and user-friendly similar to the well-known keyboard accesses.

This task is resolved with a device of the afore-mentioned kind in such a manner that the release code is entered by electronically picking-up at least one position of the handle relative to the power transmission unit.

The release code is composed of information about at least two different relative positions between the handle and the power transmission unit. Protection from unauthorized opening of a lock equipped with the inventive device is improved as the number of relative position-specific information and data in the release code rises. According to the invention, entering the code does not require any additional keyboard which would consume relatively much space and thus hamper a compact configuration of the device. Since an additional keyboard is not required, there is no demand for a separate energy supply to such a keyboard, whereby the device features very low energy consumption. Codes usually entered through a keyboard can be entered in a similarly user-friendly way through the inventive actuation of the handle of the device.

It is understood that the preceding and following statements are equally valid for the entry of a locking code instead of a release code. Furthermore, other actions, for example programming the device and/or the initial entry of a desired individual and user-specific code and the like can also be accomplished through the inventive entry of encoded data and information.

The electronic pick-up of the at least one relative position between the handle and the power transmission unit can be executed in any suitable manner. Preferably the chosen momentary position of the handle relative to the power transmission unit is picked-up through an axial movement of the handle along its rotary axis into an initial end position which entails an actuation of a switch allocated to the relative position. The configuration of this switch, too, is optional within the framework of the present invention. By actuating the switch allocated to a chosen relative position, a signal corresponding to the relative position is generated which is a constituent of the release code to be entered. Upon a subsequent rotation of the handle into another desired relative position, a signal corresponding to the relative position can be generated again by the axial movement of the handle as described before. Depending on the scope of the pre-programmed release code, this procedure can be repeated as often as desired in order to enter the required release code in this manner. Preferably the handle is spring-loaded in such a way that it moves automatically without any power impact into a second limit position in which the rotations of the handle are executed. When all the switch signals thus consecutively generated match the pre-programmed release code in terms of their sequence of entry and their type, the power transmission unit is coupled to the handle which can be pivoted about a common rotary axis.

Once completed, a manually caused rotary movement of the handle to actuate the locking mechanism of the lock can be transferred via the power transmission unit to the locking mechanism.

For programming the release code, it may for example be provided for to keep the handle in an arbitrary relative position for an extended period of time in its initial end position in which it actuates the switch, thus generating a temporally longer signal by means of the switch which signalizes that a programming of a corresponding code is to be realized. The programming procedure can furthermore be controlled and completed by an extended holding of the handle in the first end position and/or by means of distinct sequences of short and extended holding of the handle in the first end position. The two end positions, for example, are formed by mechanical limitations to the axial mobility of the handle relative to the fixing unit, wherein preferably the first end position in which the handle actuates the switch is the one which is arranged nearer to the lock. The code entry is done comfortably by turning and pressing.

In accordance with another advantageous configuration of the present invention, the device is comprised of a coupling mechanism through which the power transmission unit can optionally be coupled torque-proof to the fixing unit or to the handle. The torque-proof coupling of the power transmission unit to the fixing unit corresponds to a locking position of the device in which no movement of the locking mechanism of the lock can be performed through the device. At the same time, while the device is situated in this locking position, the power transmission unit is not torque-proof coupled to the handle so that the handle is freely pivotable about a rotary axis relative to the remaining device, without this making it possible to execute a power transmission to the locking mechanism of the lock. An unauthorized access to and/or an authorized actuation of the locking mechanism of the lock are hereby prevented. In this locking position of the device, it is furthermore possible to generate and to enter a release code in the way as described hereinabove. In the second case of this preferred embodiment of the present invention, in which the power transmission unit is torque-proof coupled to the handle, an actuation of the locking mechanism of the lock can be accomplished by a rotation of the handle. For this purpose, it is likewise required to disengage the power transmission unit from the fixing unit in order to be able to rotate at least parts of the power transmission unit together with the handle about a common rotary axis. The coupling mechanism can be configured in any appropriate way which is suitable to allow for the mentioned optional coupling between the power transmission unit and the fixing unit and the handle, respectively.

The device is expediently comprised of an electronic control unit by means of which the coupling mechanism can be electronically activated for optional coupling of the power transmission unit to the fixing unit or to the handle, respectively. This control unit preferably also serves for authentication of an entered release code, wherein such a code has previously been programmed into the control unit and saved therein so that authentication can be accomplished in the form of a matching verification between the release code and the saved code. Once the entered release code has been authenticated, the control unit activates the coupling mechanism electronically in order to be able to realize the torque-proof optional coupling of the power transmission unit to the fixing unit or to the handle, respectively.

Another advantageous embodiment of the present invention provides for that the handle can be rotated in discrete steps relative to the power transmission unit whilst it is coupled to the fixing unit. This embodiment of the invention serves for increasing operating comfort of the device because thus there is only a distinct and limited number of possible relative positions between the power transmission unit and the handle which are preferably numbered consecutively through numbers arranged at the handle and which are thus easy to select. This configuration moreover allows for simplifying the electronics needed to pick-up the selected relative positions as it merely must be comprised of a number of switches and/or contacts that corresponds to the possible relative positions. The device thus features the functionality and easy operability of conventional combination locks.

In accordance with an advantageous embodiment of the present invention, the coupling mechanism is comprised of an actuator which can be electronically activated by the control unit and by means of which the torque-proof optional coupling of the power transmission unit to the fixing unit or to the handle can be realized. Such an actuator can either actively generate movements of components of the coupling mechanism or cause a blocking to the movement of such components.

Furthermore, the device is proposed to be equipped with an energy supply unit by means of which the control unit and the actuator can be supplied with energy. The inventive device hereby becomes an autarkic device. On account of the actuation mechanism of the inventive device as described hereinabove, energy consumption of the device is cut back to a minimum, a feature that markedly improves the durability of the energy supply unit, e.g. comprised of a battery or accumulator configuration, versus prior art devices.

To resolve the afore-mentioned task, a locking system comprised of a lock, more particularly a furniture lock, which can be arranged at a component, more particularly at a door and/or window sash, is proposed, wherein the locking system is inventively characterized by a device according to one of the configurations and embodiments described hereinabove.

In accordance with the present invention, an essentially tripartite configuration is thus provided for, comprised of a fixing unit, a handle as well as a power transmission unit. This power transmission unit is so configured that it can be coupled torque-proof optionally either to the fixing unit or to the handle. When the power transmission unit is torque-proof coupled to the fixing unit, it is preferably linked to the handle via a switching means which calls for applying a slightly higher torque moment to the handle in order to rotate it preferably by a desired number of discrete steps relative to the power transmission unit and the fixing unit. Influence on the switching means can be exerted by any suitable actuator in order to modify the torque moment required for rotating the handle relative to the power transmission unit. Alternately, it is possible to provide for a separate mechanism which can indent into the switching parts, though it is less efficient and more expensive than the inventive approach. The actuator which can modify the status of the switching means is preferably also connected to a means for coupling the power transmission unit to the fixing unit so that the disengagement of the power transmission unit from the fixing unit and/or handle is accomplished simultaneously to the coupling of the power transmission unit to the handle or fixing unit.

In accordance with one of the embodiments of the present invention as described hereinabove, the handle can also be moved axially along its rotary axis in addition to its possible rotary movement relative to the power transmission unit and the fixing unit. This axial movement is preferably realized until a first end position is reached in which a switch is actuated which is allocated to the relevant relative position between the handle and the power transmission unit. For example, the switch can be configured in the form of an electrical contact between the handle and any suitable system that can electronically pick-up the momentary relative position of the handle versus the power transmission unit as the first end position is reached.

The afore-mentioned combination of features creates a device for actuating the locking mechanism of a lock in which a code can be entered by a combination of rotations and axial movements of the handle, wherein the authentication of the code leads to the result that the handle is coupled to the power transmission unit, thus allowing for a power transmission from the handle to the locking mechanism of the lock. The bi-stable coupling of the power transmission unit to the fixing unit and to the handle ensures that influences on the device, for example in the form of a rapid rotation of the handle and shock impacts, as well as an unauthorized opening of the lock are not possible.

Figure 6:
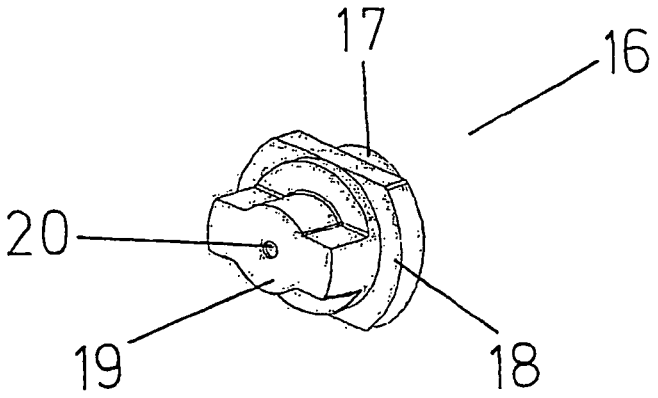
Figure 7:
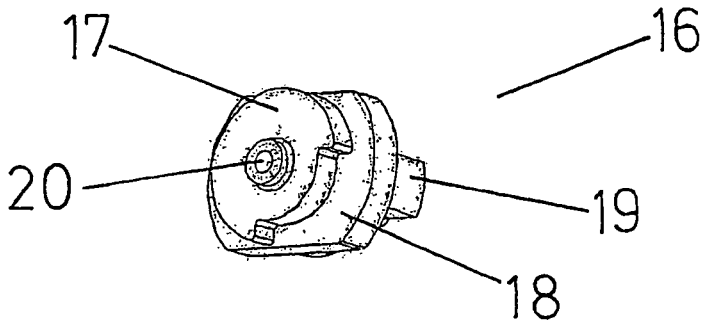

Further advantages and features of the present invention are elucidated in the following by way of practical examples outlined in the relevant figures, wherein FIG. 1: shows a perspective representation of a practical example for the inventive fixing unit, FIG. 2: shows a perspective representation of a practical example for the inventive power transmission unit, FIG. 3: shows another perspective representation of the power transmission unit shown in FIG. 2, FIG. 4: shows a perspective representation of a practical example for part of the inventive power transmission unit, FIG. 5: shows a perspective representation of a practical example for part of the coupling mechanism FIG. 6: shows a perspective representation of a practical example for the actuating element of the coupling mechanism, FIG. 7: shows another perspective representation of the actuator element shown in FIG. 6

Figure 8:
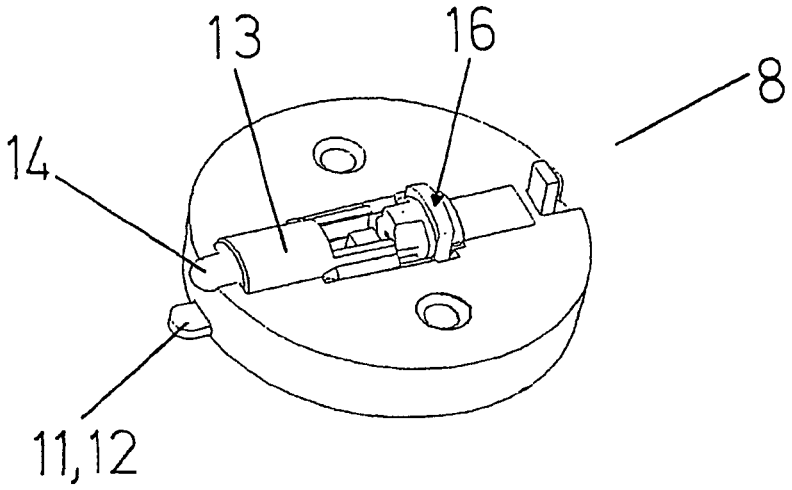
Figure 9:
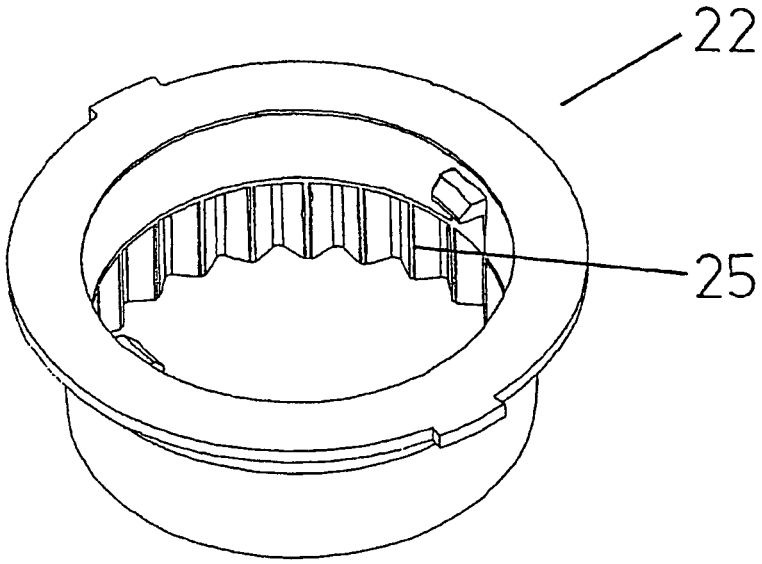
Figure 10:
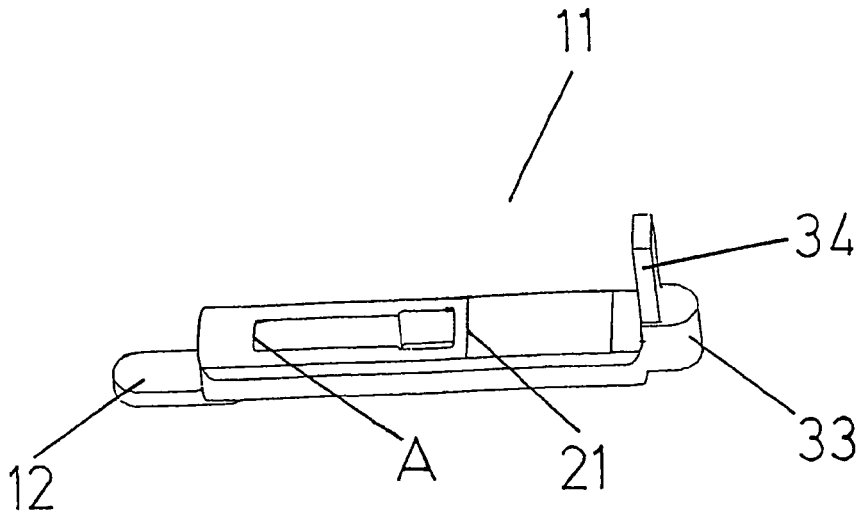
Figure 11:
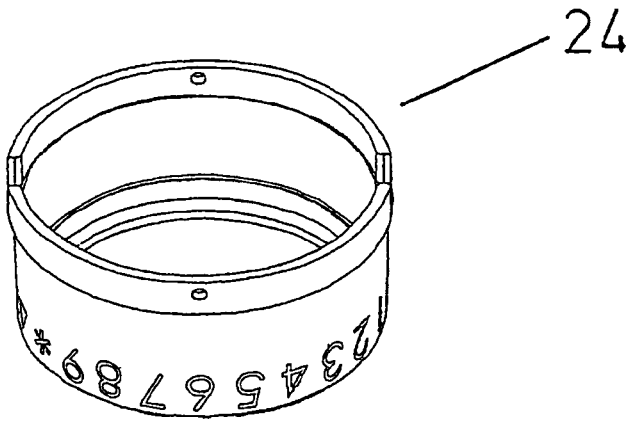
Figure 12:
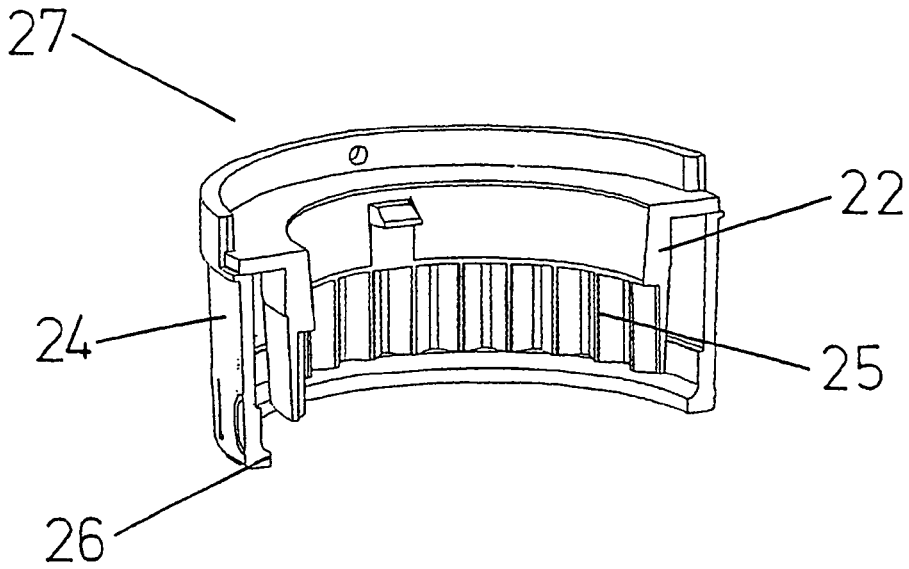
Figure 13:
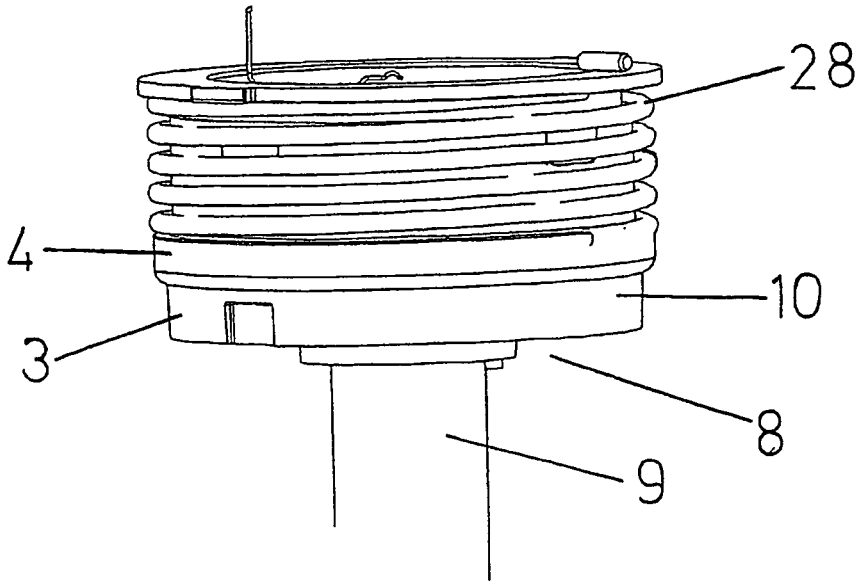
Figure 14:
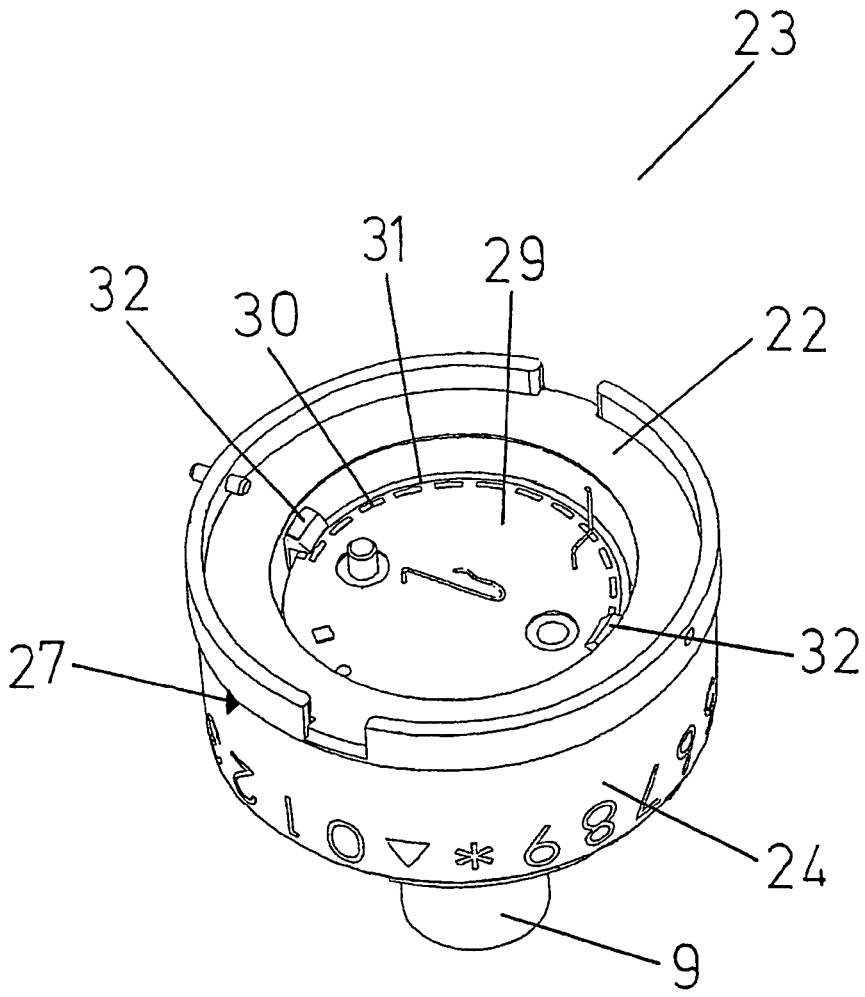
Figure 15:
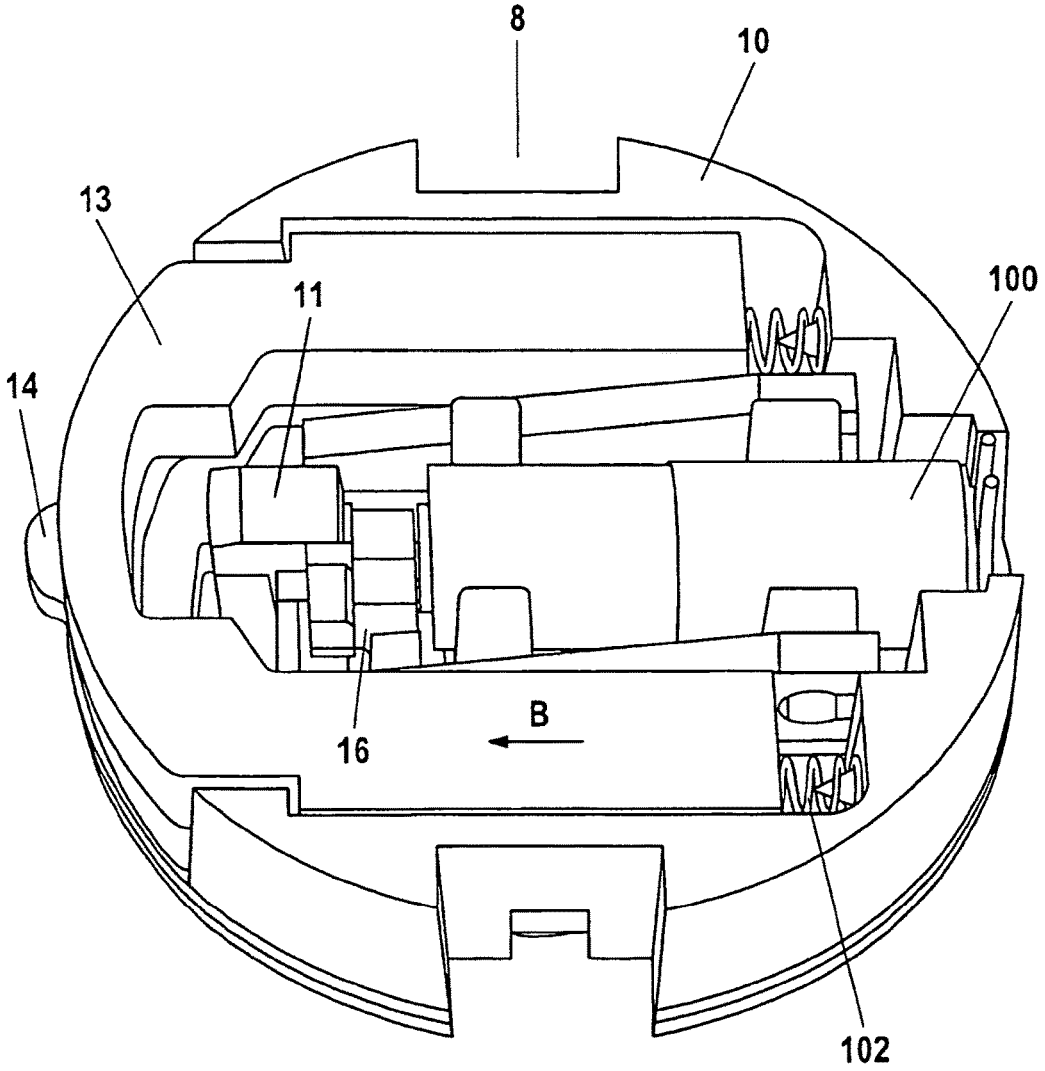
Figure 16:
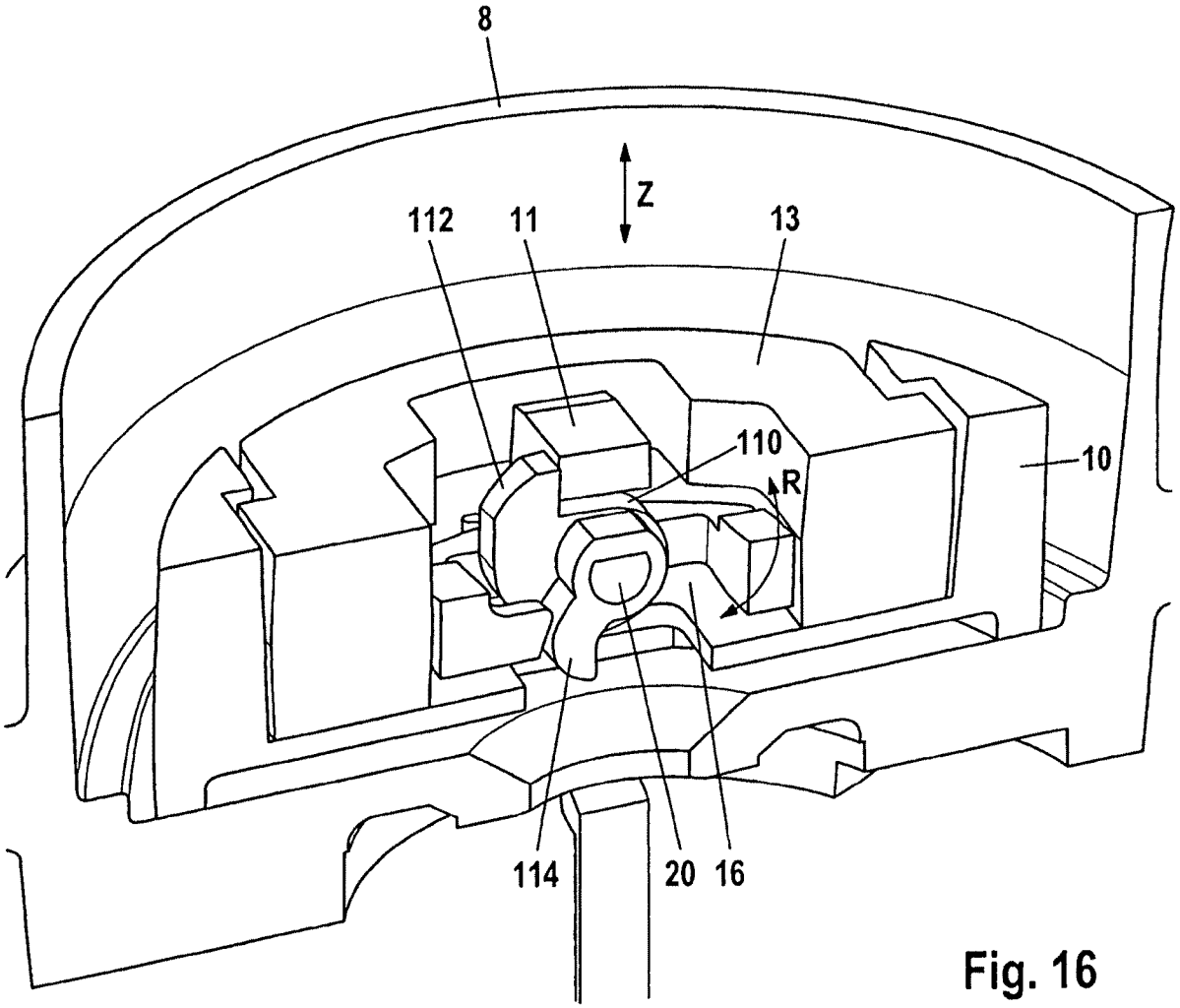
Figure 17:
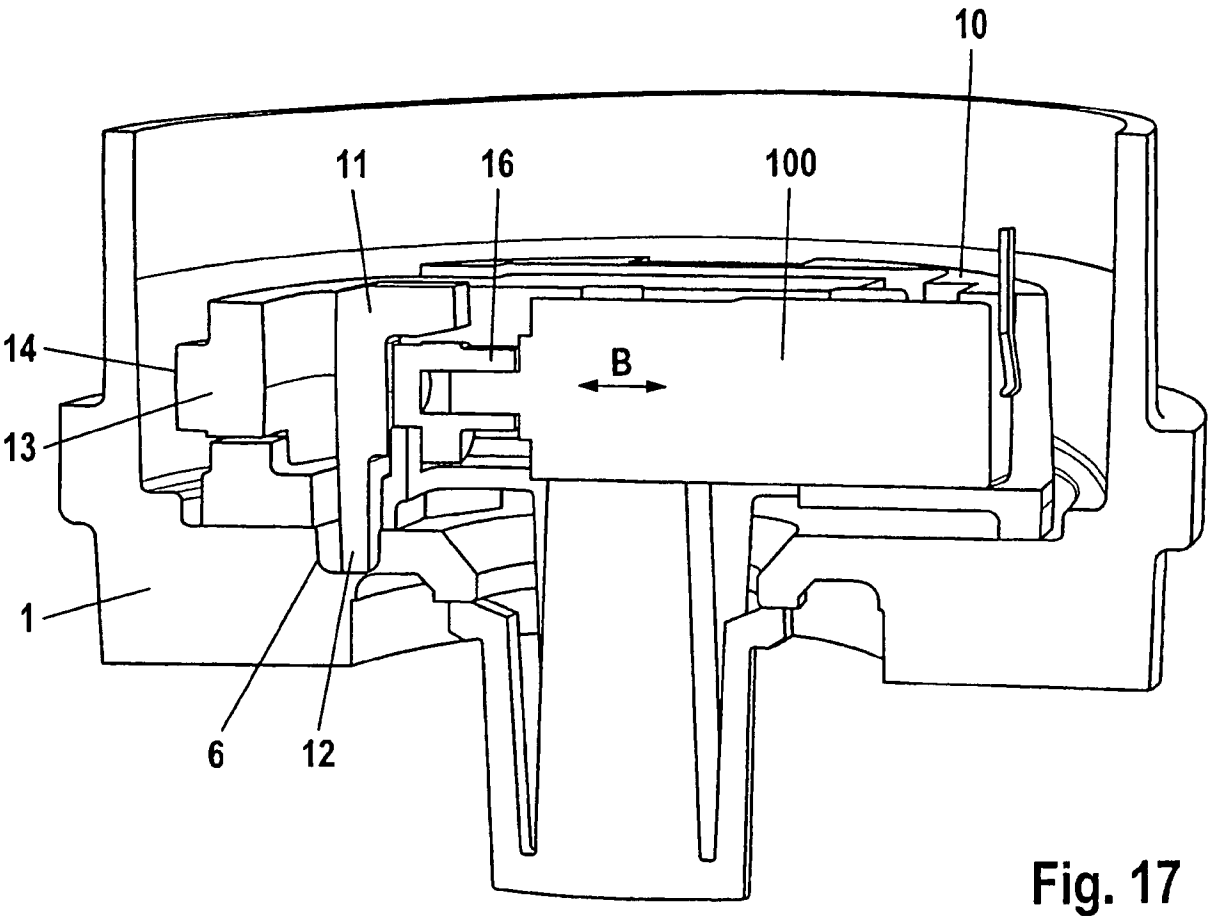
Figure 18:
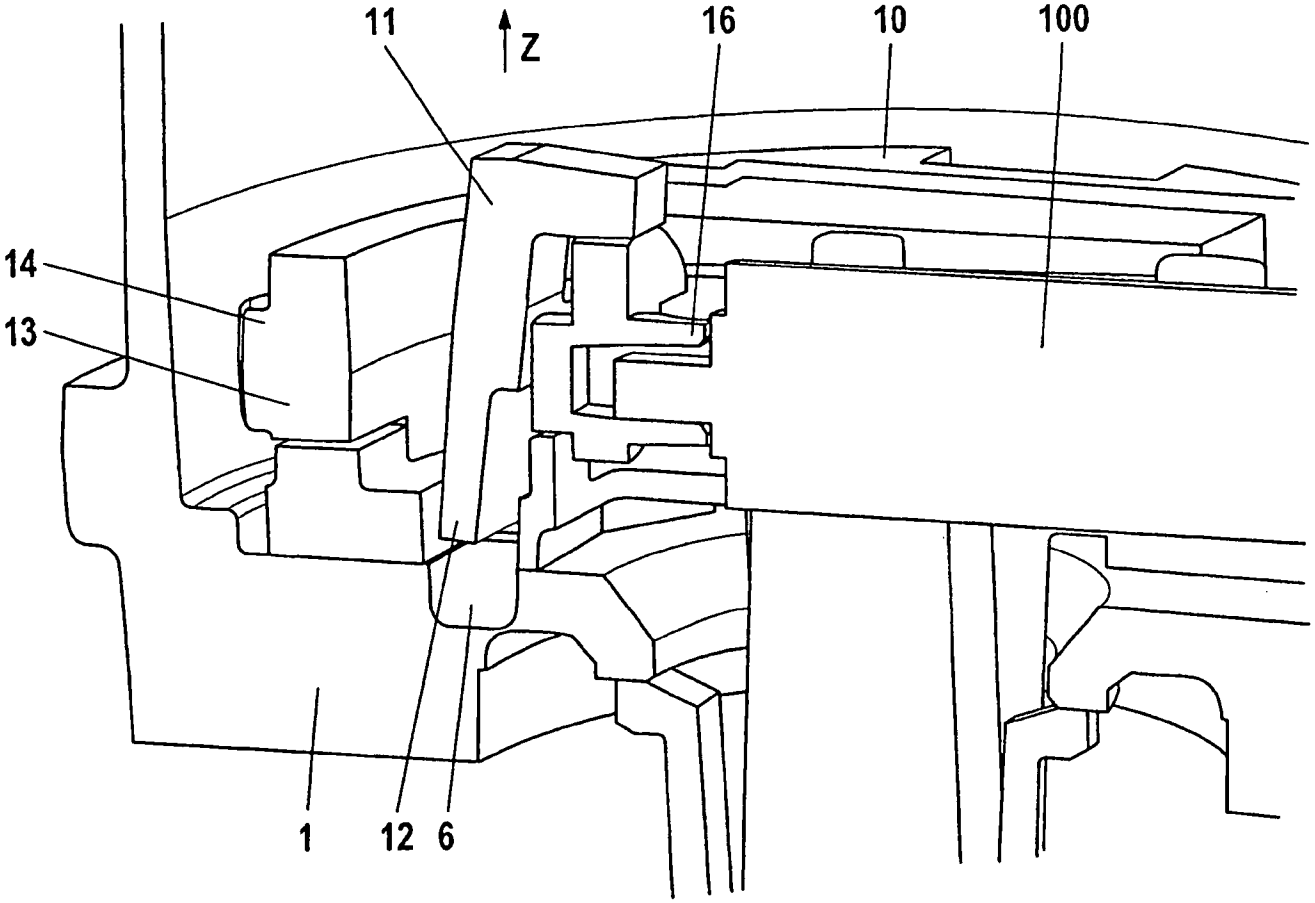
Figure 19:
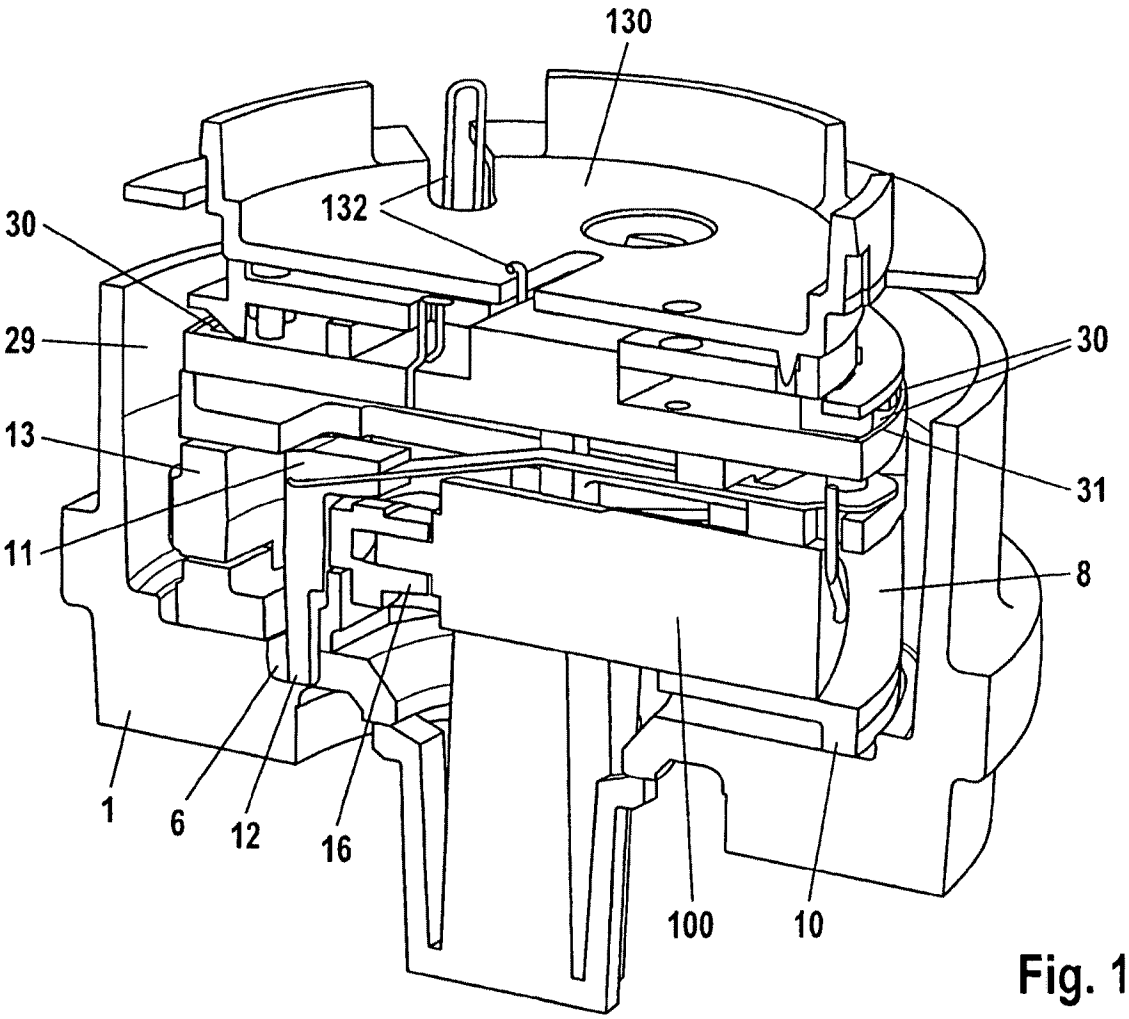

FIG. 8: shows a perspective representation of a practical example for part of the inventive power transmission unit, FIG. 9: shows a perspective representation of a practical example for the switching element of the inventive handle, FIG. 10: shows a perspective representation of a practical example for the pawl of the coupling mechanism, FIG. 11: shows a perspective representation of a practical example for the sleeve part of the inventive handle, FIG. 12: shows a perspective representation of a practical example for the inventive handle, FIG. 13: shows a perspective representation of a practical example for the inventive power transmission unit with a spring, FIG. 14: shows a perspective representation of a practical example for the inventive device, FIG. 15: shows a perspective representation of a practical example for the inventive handle, FIG. 16: shows a perspective representation of a practical example for the inventive power transmission unit with a spring, FIG. 17: shows a perspective representation of a practical example for the inventive device, FIG. 18: shows a perspective representation of a practical example for the inventive power transmission unit with a spring, FIG. 19: shows a perspective representation of a practical example for the inventive device.

FIG. 1 shows a perspective representation for the inventive fixing unit 1. Fixing unit 1 can be fastened to a non-depicted component at which a non-depicted lock which is to be actuated is also arranged. To this effect, it is comprised of bores 35 through which the bolts can be guided. Fixing unit 1 is of a pot-shaped configuration and comprised of two sections 2 and 3 with a similar outer diameter which are separated from each other by a center section 4 having a larger outer diameter. On the inside of the fixing unit 1, an annular section 5 with a recess 6 is arranged which is provided for to take-up an appropriately configured pawl 11 which is more closely shown in FIGS. 2 to 4, 8 and 10. Recess 6 represents a known position relative to the fixing unit 1 which can be designated as 0-position. Concentrically to the symmetrical axis of fixing unit 1, an outlet bearing 7 is arranged which is adapted to the arrangement of the actuation axis of a mechanical lock to be actuated.

Figure 2:
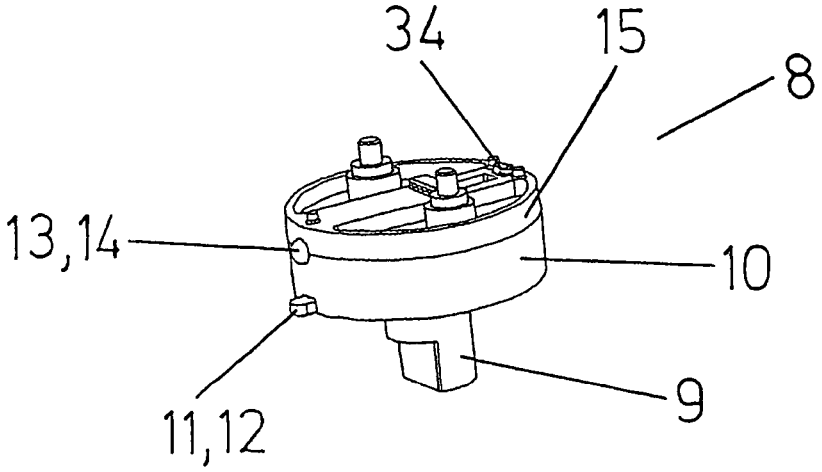

FIG. 2 shows a perspective representation of a practical example for the inventive power transmission unit 8. It is comprised of an output element 9 which can be plugged through the outlet bearing 7 of the fixing unit 1, the relevant configuration of the output element 9 being adaptable in a well known and simple manner to the relevant prevailing configuration of a lock to be actuated. The output element 9 is rigidly connected to the base body 10 of the power transmission unit 8. Arranged in the power transmission unit 8 is a pawl 11 as an integral part of the coupling mechanism which is radially displaceably arranged in the power transmission unit 8. To be seen of pawl 11 in FIG. 2 are merely the blocking pin 12 configured at one end of the pawl 11 and a signal section 34 arranged at the other end, the function of which is described further below. Pawl 11 is pre-tensioned by means of a non-depicted spring, with the spring supporting itself unilaterally at surface A as indicatively shown in FIG. 10 in order to move pawl 11 away from the axial rotation center of the power transmission unit 8. On account of this pretension, pawl 11 automatically engages into the recess 6 of fixing unit 1 when fixing unit 1 and power transmission unit 8 are suitably aligned towards each other in the 0-position.

Furthermore arranged in power transmission unit 8 is a switching means 13, of which merely the switching head 14 with a semi-spherical end is shown in FIG. 2. The end of switching head 14, however, can also be configured in any other suitable manner and way. Switching head 14 is pre-tensioned by another non-depicted spring into the direction of the arrow B in FIG. 4 in order to move switching head 14 away from the axial rotation center of power transmission unit 8 so that it protrudes beyond the rim of power transmission unit 8 as shown here.

Figure 3:
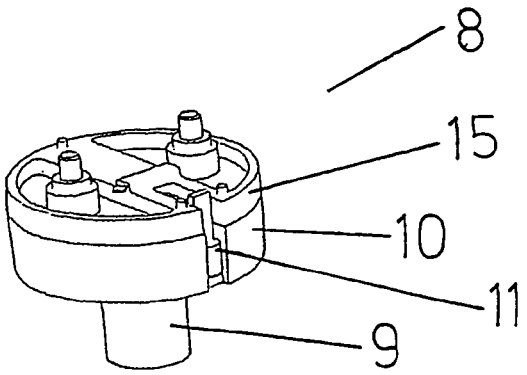

FIG. 3 shows another perspective representation of the power transmission unit 8 illustrated in FIG. 2. From this perspective, one can particularly see the signal section 34 and a retaining section 33 of pawl 11, the function of which is described in the following.

Figure 4:
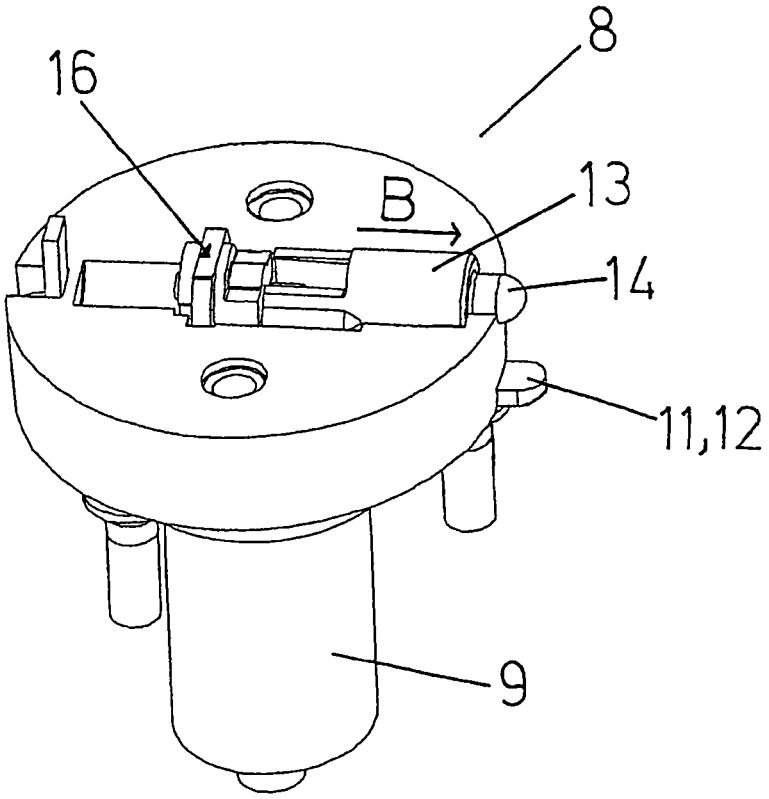

FIG. 4 shows another perspective view of the power transmission unit 8 illustrated in FIGS. 2 and 3, with the cover 15 shown in FIGS. 2 and 3 removed. Hereby, the coupling mechanism of the facility 23 can be recognized which is comprised of pawl 11 and switching means 13 which are interconnected via an actuator element 16. The coupling mechanism shown in FIG. 4 is situated in its release position in which the power transmission unit 8 is torque-proof coupled to the handle 27 shown in FIGS. 12 and 14.

Figure 5:
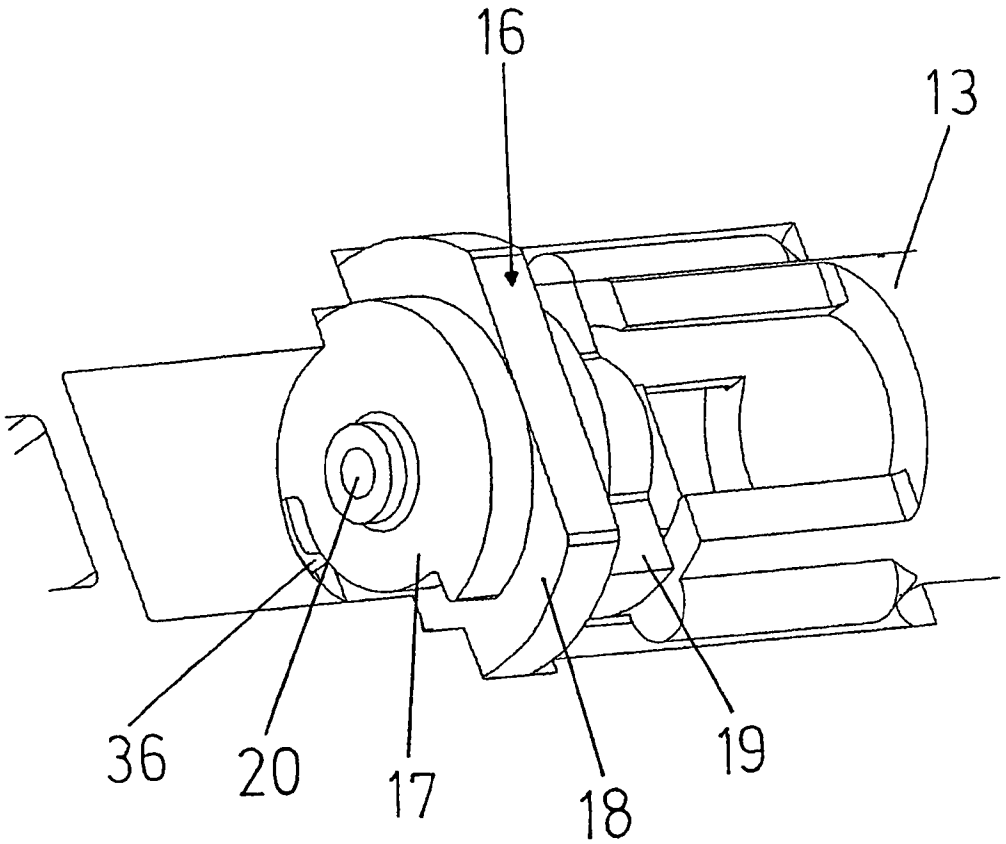

FIG. 5 shows a detail view of the coupling mechanism as illustrated in FIG. 4. The actuator element 16 is comprised of three elements 17, 18, and 19 which are pivoting mounted on a common axis 20. Each of these elements 17, 18, and 19 has a functional surface whose functional mode is described in the following. The actuator element 16 can be moved by means of a non-depicted actuator, for example an incremental path motor, from the release position shown here into a closing position and vice-versa. With the release position of the actuator element 16 shown in FIGS. 4 and 5, the sections of the element 19 lean to the side of switching means 13 facing the switching facility 16 and thus they determine the release position by preventing a radial movement of the switching means 13. Pawl 11 is comprised of a blocking surface shown in FIG. 10 which can co-act with the element 18 that is configured as a circular disc with flattenings. This is done when element 18 and/or actuator element 16, respectively, are turned by 90° from the release position shown in FIGS. 4 and 5 about axis 20, whereby a non-flattened section of element 18 engages at the blocking surface 21. With the release position of actuator element 16 shown in FIGS. 4 and 5, however, this is not the case whereby the pawl 11 is arranged radially movable in the power transmission unit 8. Thus the power transmission unit 8 can be rotated relatively to fixing unit 1 about its rotary axis. With this release position of the coupling mechanism, in which the power transmission unit 8 is torque-proof coupled to the handle shown in the following and rotatable relative to the fixing unit 1, an actuation of the locking mechanism of the lock can be effected by rotating the handle 27. In order to rotate the actuator element 16 from its release position shown in FIGS. 4 and 5 into its closing position, an arbitrarily configured suitable actuator is employed which is electrically activated by the control unit 29 illustrated in FIG. 14. To limit the rotary mobility of the actuator element 16, the element 17 features a recess extending by about 90° of its circumference which co-acts with a blocking section 36 arranged at the base body 10 of power transmission unit 8. To elucidate the configuration of actuator element 16, FIGS. 6 and 7 show further perspective representations of actuator element 16.

FIG. 8 shows another perspective representation of part of the power transmission unit 8 and of the coupling mechanism which is situated in its closing position. This closing position has been reached by the fact that the actuator element 16 has been rotated by 90° versus the position shown in FIGS. 4 and 5 so that the blocking surface 21 of pawl 11 co-acts with one of the non-depicted sections of element 18. The position of pawl 11 illustrated in FIG. 8 is hereby fixed. Pawl 11 and, respectively, its blocking pin 12 are situated in the recess 6 at fixing unit 1 so that power transmission unit 8 is torque-proof coupled to fixing unit 1. This prevents torsion of power transmission unit 8 relative to fixing unit 1 and thus an actuation of the locking mechanism of the lock. At the same time, because of the 90° rotation of element 19, the sections of element 19 which are arranged downstream of the bifurcation of switching means 13 so as to block movements of switching means 13 are moved away so that the switching means 13 and thus the switching head 14 are enabled to move in radial direction relative to the power transmission unit 8. In this closing position of the coupling mechanism, an entry of the release code can be effected which upon authentication by control unit 29 causes a rotary movement of the actuator element 16.

FIG. 9 shows another perspective view of a switching part 22 of handle 27. Moreover, handle 27 features the sleeve part 24 illustrated in FIG. 11 which can be fastened to the switching part 22 in order to form handle 27. Switching part 22 fits in between the outer diameter of power transmission unit 8 and the inner diameter of fixing unit 1 and it is torque-proof and displaceably arranged relative to it. Switching part 22 is essentially configured like a cylinder and it has a number of teeth 25 at its inner diameter. The inner diameter of switching part 22 is properly chosen this way in order to ensure that switching part 22 can be rotated around the power transmission unit 8. On this rotation, switching part 22 presses the switching head 14 of switching means 13 into the base body 10 of power transmission unit 8. The teeth 25 on the inside of switching part 22 are deep enough to allow for leaving the switching head 14 when switching means 13 and switching part 22 are moved relative towards each other in a suitable manner and way. Owing to this configuration of facility 23, switching part 22 moves in discrete steps. In the configuration shown here, 24 steps of 15° have been selected. The shape of the teeth 25 has been properly chosen to render a dwelling of the system in an intermediate position between teeth 25 unlikely.

Switching part 22 is rigidly and coaxially connected to sleeve part 24. This sleeve part 24 is configured as a cylindrically shaped component with a reduced end 26 as one may gather from FIG. 12. The aperture at this end 26 is larger than the outer diameter of sections 2 and 3 of fixing unit 1, but smaller than the outer diameter of the center section 4. When sleeve part 24 has been connected to switching part 22, the handle 27 hereby formed can be freely rotated, but it has a limited axial mobility, typically in a magnitude of 1 to 2 mm. A spring 28 shown in FIG. 13 takes effect between fixing unit 1 and handle 27 in order to keep the latter under tension and in order to move it away from the assembly surface and, respectively, from the fixing unit when there is no force impacting on handle 27. The assembly surface, for example, is the door or outer surface of the component which the facility 23 is to be fastened to.

By means of the described facility 23, a code can be entered, but without the actuator element 16 it would be required to utilize a very stiff spring to retain the pawl 11 in the recess 6 of fixing unit 1. A spring sufficiently rigid for this function would make it much more difficult and call for much higher power to perform the opening movement, possibly up to an extent at which a user believes the lock would still be in its closing position rather than in the really existing opening position. Overcoming such a stiff spring would also enhance the forces impacting on the inner components of facility 23 each time when facility 23 is actuated.

As one may gather from FIG. 14, there is a control unit 29 in the form of a printed circuit board situated between the power transmission unit 8 and handle 27. Control unit 29 provides the standard functions of a known lock control circuit and carries the electronic components required for this purpose. It fulfils the additional function in this configuration of recording the entry of the relevant code. The entry function is reached by the arrangement of a suitable number of contact fields 30 which are peripherally arranged at the printed circuit board along a common contact field 31. Contact fields 30 are so positioned that each contact field 30 corresponds to a switching position and thus to a relative position between handle 27 and power transmission unit 8. In the case of 24 discrete steps, contact fields 30 have an angular extension of nearly 10° in order to allow for sufficient electrical isolation among each other.

In another advantageous embodiment of the present invention, the number of contact fields 30 on the printed circuit board corresponds to half the number of possible discrete steps. Accordingly, each number allocated to a relative position is preferably repeated once on the sleeve part 24 as outlined in FIGS. 11 and 14 so that the selected entry can be read-off from handle 27 at top and bottom. This configuration bears the advantage in that the lock on doors and the like can be positioned both at top and at bottom, without the choice of positioning adversely affecting the operation of facility 23. To realize this configuration, switching part 22 features two short-circuit contacts 32 diametrically arranged at the inner periphery of switching part 22 which can establish a connection between the common contact field 31 and one of the contact fields 30. Since contact fields 30 have an angular extension corresponding to the steps, the contact fields 30 fit into 180° of the circumference of the printed circuit board, wherein merely one short-circuit contact 32 can be in contact with contact fields 30 and 31 in any of the possible relative positions.

The fixing of the printed circuit board on the power transmission unit 8 takes the effect that the relative position of contact fields 30 towards fixing unit 1 is changed when the power transmission unit 8 has been coupled to handle 27. If the system is designed to get loose independently without being correctly aligned in relation to fixing unit 1, a staggering of registered numbers will occur. To prevent this, the pawl 11 is provided with a retainer section 33 so that the tip of retainer section 33 is situated in the base body of power transmission unit 8 when pawl 11 engages into the recess 7 at fixing unit 1. When pawl 11 is freely displaceable by a rotation of actuator element 16 into its release position and when a rotation of power transmission unit 8 is effected by its user, then the actuator of pawl 11 causes the retaining section 33 to engage at one of teeth 25 of switching part 22 and thus the power transmission unit 8 is mechanically coupled to handle 27, irrespective of the relevant status of switching head 14 and actuator element 16. The quality of the coupling between power transmission unit 8 and handle 27 is thereby improved, thus also improving the resistivity against wear and tear.

Had the actuator element 16 the intention to rotate when pawl 11 is not situated in recess 6 of fixing unit 1, the actuator element 16 would not position itself correctly relative to the blocking surface 21. Therefore, a signal section 34 is arranged at pawl 11, said signal section co-acting with any appropriate sensor, for example a spring wire contact, in order to confirm towards the control unit 29 that facility 23 has reached its 0-position and that the actuator element 16 can be rotated to modify its status.

Facility 23 depicted in FIG. 14 is still to be provided with a non-depicted cover which can be fastened to the handle and which protectively covers the control unit 29. This cover can be configured of any desired kind and type.

A use of master and multiple-user codes with actuation verification is known to be an advantage of electronic locks, and one or all of these features may be implemented in connection with the present invention. For example, alternative methods for entering the code can be applied, e.g. via a wireless or non-wireless interface utilizing surrounding maps, cell phones with wireless communication, biometrical data and the like. Even an integration into a wired or wireless network utilizing any appropriate protocol, e.g. an internet protocol or 802.11, is feasible, with all these techniques being known and freely obtainable. Each of these systems can be utilized in parallel to the described code entry as long as a suitable energy supply is available.

FIG. 15 illustrates a perspective view of an alternative power transmission unit 8. In power transmission unit 8, in turn, a switching means 13 is arranged at which the switching head 14 is shown with a semi-spherical end. The switching means features a U-shape, with the legs supporting themselves via springs 102 at the base body. The end of switching head 14, however, can be configured in any appropriate manner here, too. Switching head 14 is pretensioned by springs 102 towards the direction of arrow B in FIG. 4 in order to move switching head 14 away from the axial rotary center of power transmission unit 8 so that it protrudes as shown beyond the rim of power transmission unit 8.

Likewise visible in FIG. 15 is the actuator element 16 through which the mobility of a pawl 11 non-depicted in FIG. 15 and of the switching means 13 is regulated. Actuator element 16 can be moved by means of actuator 100, for example an incremental path motor, from a release position into a closing position and vice versa.

FIG. 16 shows a perspective representation of power transmission unit 8 from FIG. 15. Now clearly visible is the actuator element 16 featuring elements 110, 112, and 114 which are pivoting mounted on a common axis 20. Elements 112 and 114 represent limit stops in order to confine a rotation of actuator element 16 in the direction R. The surface 110 features a circumference which constantly changes in rotary direction R so that on rotating the actuator element the pawl 11 experiences an upward and downward movement in the direction z. Owing to this movement, pawl 11 is moved between one release position and one closing position. This may be elucidated in detail hereinafter in FIGS. 17 and 18:

FIG. 17 shows another perspective representation of power transmission unit 8 from FIG. 15. In the closing position shown here, the actuator element 16 is so rotated by means of motor 100 that the blocking pin 12 formed at one end of pawl 11 constantly engages into a counterpart recess 6 of fixing unit 1. In this closing position, the switching head 14 can be moved in the direction B so that a movement of a handle non-depicted in FIG. 17 merely causes a rotation of the same relative to the base body 10 and thus to the power transmission unit 8. The reason lies in that recesses, e.g. tooth-shaped recesses (see FIG. 8, teeth 15) allow the switching head 14 to engage into the same, to be true, but owing to the fixation of the power transmission unit at the fixing unit via pawl 11 and because of the mobility of the switching head in the direction of B, merely a "slippage" of the switching head 14 at these tooth-shaped recesses is effected when the handle is rotated—but a power transmission to the power transmission unit 8 and thus to one of the output elements 9 (non-depicted) arranged at the power transmission unit 8 is not realized.

FIG. 18 now schematically shows the release position of the actuator element 16 which was prompted by a rotation of actuator element 16 by means of motor 100. Owing to the rotary movement of the actuator element, pawl 11 was raised in the direction of z, whereby the blocking pin 12 formed at the end of pawl 11 does no longer engage into the counterpart recess 6 of fixing unit 1. At the same time, switching means 13 is blocked, thus preventing a movement of switching means 13 in the direction B shown in FIG. 17—the switching head 14 of switching means 13 permanently stays in its position shown in FIG. 18 and thus it constantly engages into one of the tooth-shaped recesses of a handle non-depicted in FIG. 18. With this release position of the coupling mechanism, the power transmission unit 8 is thus torque-proof coupled to the handle and besides it can be rotated relative to the fixing unit 1. Thus, an actuation of the locking mechanism of the lock can be accomplished by rotating the handle.

FIG. 19 finally shows a perspective cross-sectional view of a device for actuating the locking mechanism of a lock. The device is comprised of the fixing unit 1 and the power transmission unit shown in FIG. 15. As has already been depicted in FIG. 14, a control unit 29 in the form of a printed circuit board is situated between the power transmission unit 8 and the handle 27 (non-visible in FIG. 19). An entry function is again achieved by the arrangement of an appropriate number of contact fields 30 which are peripherally arranged at the printed circuit board along a common contact field 31. Furthermore, FIG. 19 shows a cover of the printed circuit board in the form of a battery take-up 130 through which electrical contacts 132 of the printed circuit board are guided which serve for power supply to the printed circuit board, utilizing a battery non-depicted in FIG. 19 and to be inserted into take-up 130.

The invention claimed is:

1. A device (23) for actuating the locking mechanism of a lock, said device comprising a fixing unit (1) for fastening the device (23) to a component at which the lock is also arranged, and comprising a handle (27) which is pivoting mounted about a rotary axis at the fixing unit (1) and through the rotation of which the locking mechanism can be manually actuated, and comprising a power transmission unit (8) which can be torque-proof coupled to the handle (27) to transmit the power applied on rotating the handle (27) to the locking mechanism, wherein the power transmission unit (8) is not coupled torque-proof to the handle (27) until a release code is entered and authenticated, and wherein the entry of the release code is effected by way of electronically picking-up at least one position of the handle (27) relative to the power transmission unit (8), and wherein the power transmission unit (8) comprises a coupling mechanism through which the power transmission unit (8) is torque-proof coupled either to the fixing unit (1) or to the handle (27).

2. A device (23) according to claim 1, wherein the at least one position of the handle (27) relative to the power transmission unit (8) is caused to be electronically picked up via an axial movement of the handle (27) along its rotary axis into an end position whereby a switch allocated to the relative position is actuated.

3. A device (23) according to claim 1, comprising an electronic control unit (29), by means of which the coupling mechanism for optional coupling of the power transmission unit (8) to the fixing unit (1) or to the handle (27) can be electronically activated.

4. A device (23) according to claim 3, wherein the power transmission unit (8) can only be coupled torque-proof to the handle (27) by means of the control unit until a release code has been entered into the control unit (29) and been authenticated.

5. A device (23) according to claim 3, wherein the coupling mechanism is comprised of an actuator which can be electronically activated by the control unit (29) and by means of which the torque-proof optional coupling of the power transmission unit (8) to the fixing unit (1) or to the handle (27) is feasible.

6. A device (23) according to claim 5, comprising an energy supply unit by means of which the control unit (29) and the actuator can be supplied with energy.

7. A device (23) according to claim 1, wherein the handle (27) can be rotated in discrete steps relative to the power transmission unit (8) whilst it is coupled to the fixing unit (1).

8. A device (23) according to claim 7, wherein the handle (27) is comprised of a switching part (22) and wherein the switching part (22) at its inner diameter features a number of teeth (25) to allow for a movement of the switching part (22) in discrete steps.

9. A locking system comprising a lock that can be arranged at a component, and comprising a device (23) according to claim 1.

* * * * *